United States Patent [19]

Balandis

[11] 3,945,546

[45] Mar. 23, 1976

[54] ZIG-ZAG FOLDED STRIP BOTTOM FEEDER

[75] Inventor: Leo Steven Balandis, Rochester, N.Y.

[73] Assignee: Xerox Corporation, Stamford, Conn.

[22] Filed: Sept. 25, 1974

[21] Appl. No.: 508,923

[52] U.S. Cl. ..... 226/118; 270/61 F

[51] Int. Cl.[2] ..... B65H 17/00

[58] Field of Search ..... 226/118, 119; 270/52.5, 270/61 F, 79; 355/16; 19/160, 163; 271/165, 166, 95

[56] References Cited

UNITED STATES PATENTS 3,871,763 3/1975 Schrempp ..... 226/119 X

FOREIGN PATENTS OR APPLICATIONS 897,056 5/1962 United Kingdom ..... 271/95

*Primary Examiner*—Richard A. Schacher

[57] ABSTRACT

A tray for accommodating flat pack material such as computer fanfold adapted to enable feeding of the flat pack from off the bottom of the tray. The subject tray includes a base section comprising a plurality of rollers distributed for movement in a track means such that the rollers move back and forth in correspondence with unfolding movement of the flat pack. As another embodiment, the rollers may be reciprocated back and forth in timed relationship with unfolding of the flat pack by drive means.

10 Claims, 7 Drawing Figures

ZIG-ZAG FOLDED STRIP BOTTOM FEEDER

This invention relates to a tray useful with copiers, and more particularly to an improved tray for handling flat pack material.

It is sometimes desirable, in copier or reproduction machine environments, to handle endless web type material such as computer fanfold. This may take the form of either an original to be copied and/or the sheet material on which copies are produced. In either event, handling of web material, i.e. feeding, stacking, unstacking, etc. is difficult to accomplish reliably and without damaging or tearing the web material.

One aspect of the above that poses a particularly difficult problem involves attempts to unstack a pile of fanfolded material, conventionally termed a flat pack, particularly where it is desired to unstack, i.e., feed, from the bottom of the pack. In that circumstance the pack, which is normally supported in a tray must unfold, at least initially, against the weight of the web material stacked on top. Some prior art trays have, in their attempt to accomplish bottom feeding from a flat pack provided relatively complex mechanism with attendant high frictional characteristics.

It is therefore a principal object of the present invention to provide a new and improved tray for use with document reproduction apparatus.

It is a further object of the present invention to provide an improved apparatus for bottom feeding a pack of fanfolded web.

It is an object of the present invention to provide an improved feed tray for fanfolded material.

It is an object of the present invention to provide an improved low friction feed tray for flat pack material.

It is an object of the present invention to provide apparatus for supporting flat pack material for feeding such material from the bottom of the pack.

It is an object of the present invention to provide a power unfolder for use in feeding fanfolded web from the bottom of the fanfolded supply pack.

This invention relates to a pack tray for supporting an endless web fanfolded into a pack for feeding of the web from off the bottom of the pack, the combination comprising plural tray base members arranged in substantially parallel relationship to one another and movable in a direction paralleling the direction of unfolding of the web from the pack; and tray end walls defining parallel track segments within which the terminal ends of the base members are supported for movement in the direction as aforesaid, the web being routed from the web pack between an adjoining pair of the members such that on oscillation of the web as the web unfolds from the pack, the base members move in unison therewith back and forth in the aforesaid track segments.

Other objects and advantages of the present invention will be apparent from the ensuing description and drawings in which.

In the ensuing description, tray 110 of the present invention is described in the environment of an exemplary copying or reproduction apparatus, tray 110 in that environment being used to support a fanfolded web of original documents or masters to be copied. However, it will be understood that tray 110 may be used in other applications and environments where it is desired to provide both support and feeding facilities for fanfold material.

Figure 1:
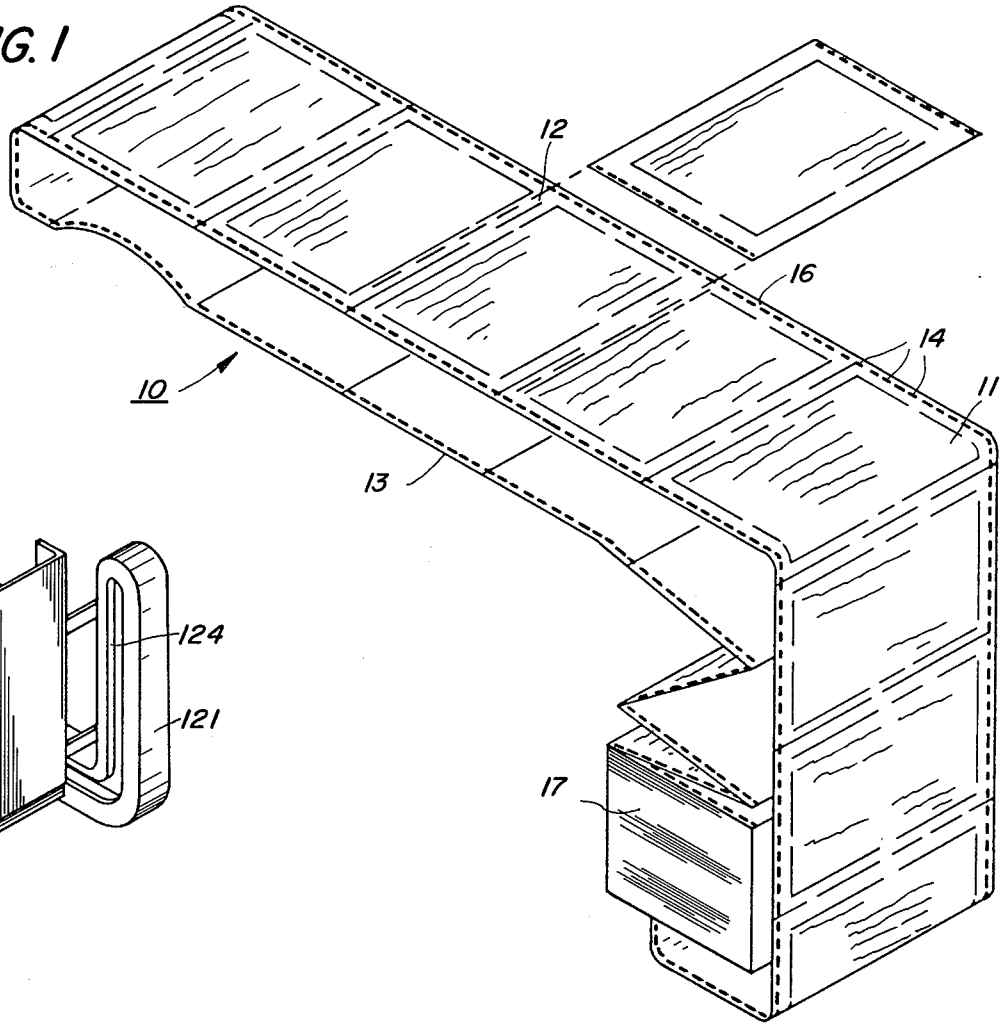
FIG. 1 is an enlarged isometric view showing a fanfold web of the type adapted for handling by the tray of the present invention.
Figure 2:
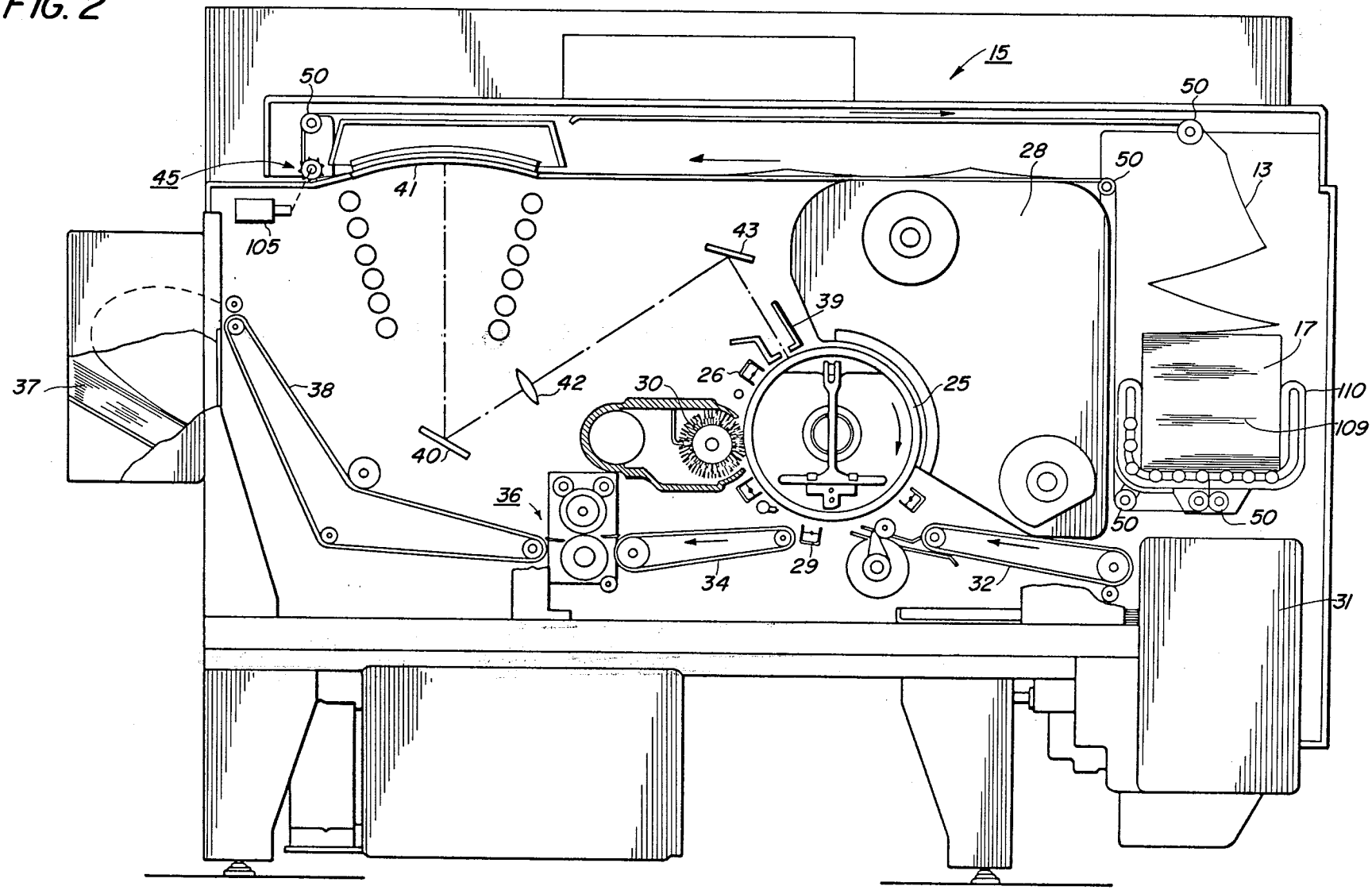
FIG. 2 is a schematic view of an exemplary copier with which the tray of the present invention may be used.

Referring now to FIGS. 1 and 2 of the drawings, there is shown fanfold material, designated generally by the numeral 10, which feed tray 110 of the present invention is esepcially adapted to handle. Fanfold material 10 comprises, in the exemplary arrangement illustrated, a series of original documents or masters 11 fastened together end to end as by means of flexible tape 12 to form an endless web 13. The web 13 of masters 11 may be used with a suitable electrostatic type copying apparatus, such as the copier 15 shown in FIG. 2, to produce copies of masters 11. To facilitate the copying procedure, particularly where the masters 11 are copied a number of times in succession, the terminal ends of web 13 may be joined together to form an endless loop to be recirculated once for each full copy set or book desired, copier 15 being provided with suitable feeding means 45 engageable with holes 14 in the side margins 16 of web 13 to advance web 13 and masters 11 thereof into and out of copying position.

Where the length of web 13 is substantial, the portion of web not in process is folded into a pack 17, conventionally termed a flat pack. Flat pack 17 is held in tray 110, fresh web material being drawn from the bottom of the flat pack 17 through tray 110 while used web material returns onto the top of flat pack 17 as will appear more fully herein.

Masters 11 may comprise any type of original document, i.e. drawing, letter, etc. Masters 11 may be prepared individually as by means of xerographic flat plate equipment or directly onto fanfolded web material as by means of a typewriter employing a sprocketed paper feed platen, or by a computer impact printer, etc. Where the masters 11 are prepared individually, the masters are fastened together as by means of flexible tape 12.

Referring now to FIG. 2 of the drawings, the exemplary copier 15 includes a rotatable xerographic drum 25, a corona charging device 26, a xerographic developer 28, a transfer corotron 29 and a drum cleaning brush 30. Copy paper in the form of cut sheets stored in supply tray 31 are fed out one by one by a suitable paper feeder (not shown) onto conveyor 32. Conveyor 32 brings the individual sheets into operative transfer relationship with drum 25 opposite corotron 29 whereat transfer of the image developed on drum 25 to the individual copy sheets takes place. Conveyor 34 carries the image bearing sheets to a roll type fuser 36 where the toner delineated image is permanently fixed.

The fused copy is discharged into output tray 37 by conveyor 38.

The xerographic drum 25, following cleaning by brush 30, is charged by the corona charging device 26 prior to exposure to the image being copied at exposure station 39. The image at station 39 originates from scanning by rotating mirror 40 the document resting on platen glass 41, the image reflected by mirror 40 passing through lens 42 and mirror 43 onto the surface of drum 25 at exposure station 39.

Copier 15 is adapted to copy either single page documents or continuous documents such as fanfolded web 13. For this purpose, copier 15 includes, adjacent one side of platen glass 41, a form or web feeder comprising a pair of sprocketed feed rolls 45 cooperable with edge perforations 14 in web 13 to draw the web across platen glass 41. Feed rolls 45 are intermittently driven to draw or index web 13 in increments corresponding to a page, copying thereof being effected while web 13 is stopped.

Web 13 is fed from flat pack 17 stored in tray 110 appended to one side of copier 15. For this purpose, suitable pinch and guide rolls 50 are provided to guide web 13 from tray 110 to copier 15 and from copier 15 back to tray 110 as shown by the solid line arrows in FIG. 2. It will be understood that web 13 need not be recirculated, and in this circumstance, a second tray structure may be provided to receive used web.

Figure 3:
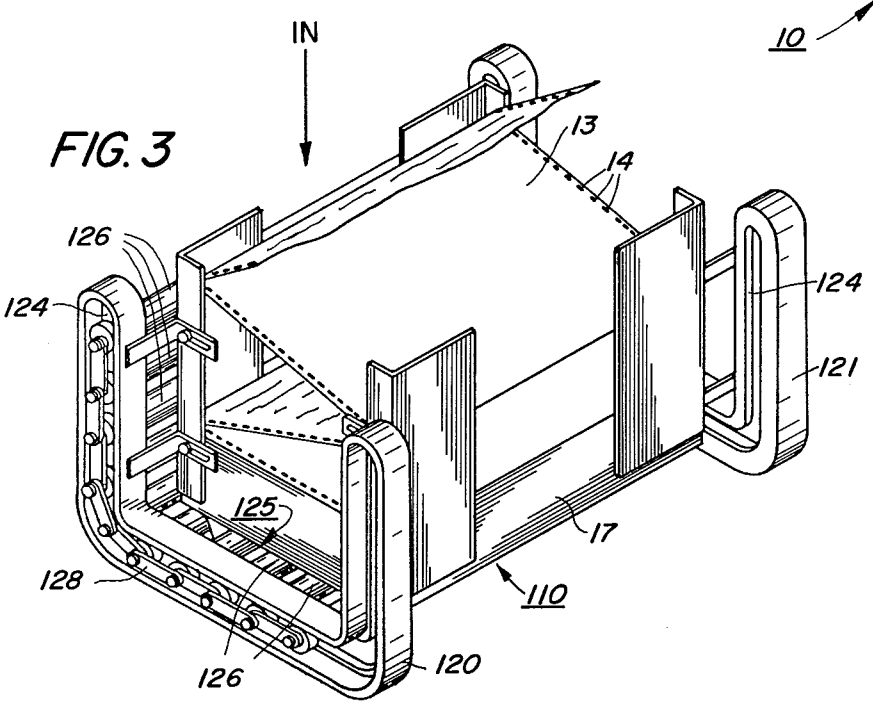
FIG. 3 is an enlarged isometric view showing details of the tray of the present invention.

Referring now to FIG. 3, supply tray 110, comprises a pair of side members 120, 121. In the embodiment shown, members 120, 121 are generally U-shaped to form a U-shaped track 124 through which a series of rollers 126, making up base 125 of tray 110 extend. This track configuration reduces space requirements of tray 110. However, as will be understood, side members 120, 121 and the track 124 formed thereby may be horizontal.

Rollers 126 rest within and are supported by side members 120, 121, the dimension of tracks 124 being slightly larger than the diameter of rollers 126. By this construction, rollers 126 are free to turn and base 125 to move back and forth within the confines of tracks 124.

The number of rollers 126 utilized is sufficient to support the pack 17 of fanfolded material, and in the exemplary embodiment shown, eight rollers 126 are provided with web 13 being fed between the innermost roller pair. To maintain tray base forming rollers 126 in spaced relationship relative to one another, spacer links 128 are pivotally secured between adjoining rollers at each end thereof.

Figure 6:
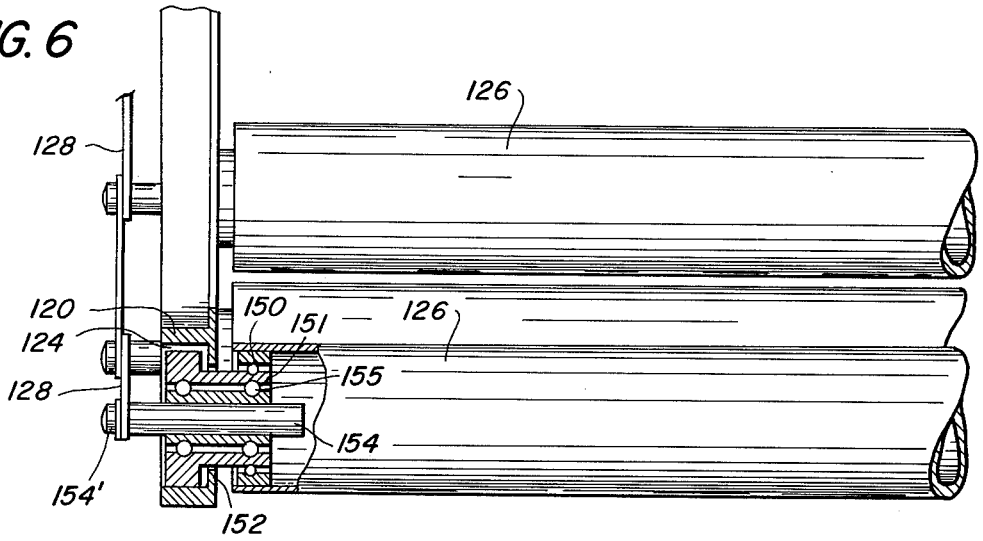
FIG. 6 is an enlarged cross section view showing details of the tray base roller bearing support along lines 6/6 of FIG. 4.

As seen best in FIG. 6, each roller 126 is journaled by bearing 150 on the outer race of tracking wheel 151, which rides in track 124. To control movement of rollers 126 in the axial direction, the inside section of side members 120 depends at 152 into the track area.

Locating pins 154 are provided, pins 154 being journaled by bearing 155 in coaxial alignment with tracking wheels 151. Spacer members 128 for rollers 126 are rotatably attached to the outer extremity 154' of pin 154.

Figure 4:
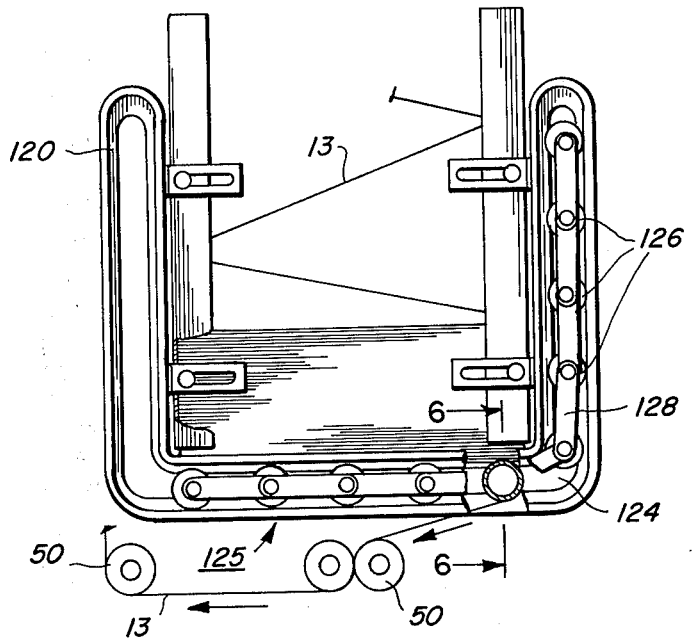
FIG. 4 is a side view in cross section showing the displaceable tray base of the tray shown in FIG. 3 in one extreme position.
Figure 5:
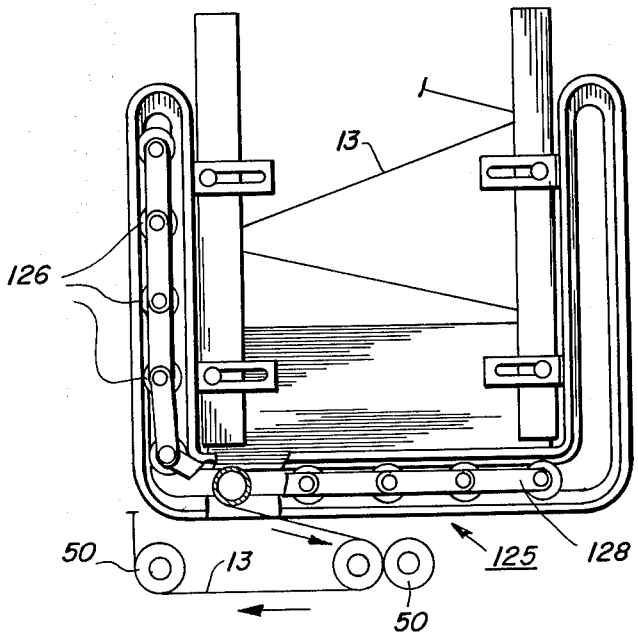
FIG. 5 is a side view in cross section showing the displaceable tray base of the tray shown in FIG. 3 in the opposite extreme position.

In operation, as web 13 is withdrawn from the bottom of pack 17, base 125 oscillates back and forth within tracks 124 in accordance with the point of unfolding of web 13 from pack 17. This displacement at the point of unfolding reduces the force required to unfold web 13 and prevents tearing or ripping thereof. Note FIGS. 4 and 5.

To reproduce copies from web 13, the master, in the form of a flat pack 17 and with leading and trailing web ends free, is set into supply tray 110. In doing so, the leading end is inserted between the innermost rollers of base 125, and from there routed between and over guide rollers 50 to platen 41. There, the leading end is led across platen 41, and threaded onto the sprocketed feed rolls 45. Following this, the leading and trailing ends of web 13 may be joined together by tape 12 to form an endless loop where repetitive copying is desired.

As copies of the web 13 are made, fresh web material is unfolded from the bottom of pack 17 and routed over guide rolls 50 to platen 41. At the same time, the used web material is restacked onto pack 17. The above proceeds until the last page on web 13 has been copied, at which point copier 15 is stopped or the above procedure repeated to form another set of copies in accordance with the program under which copier 15 is operated.

Figure 7:
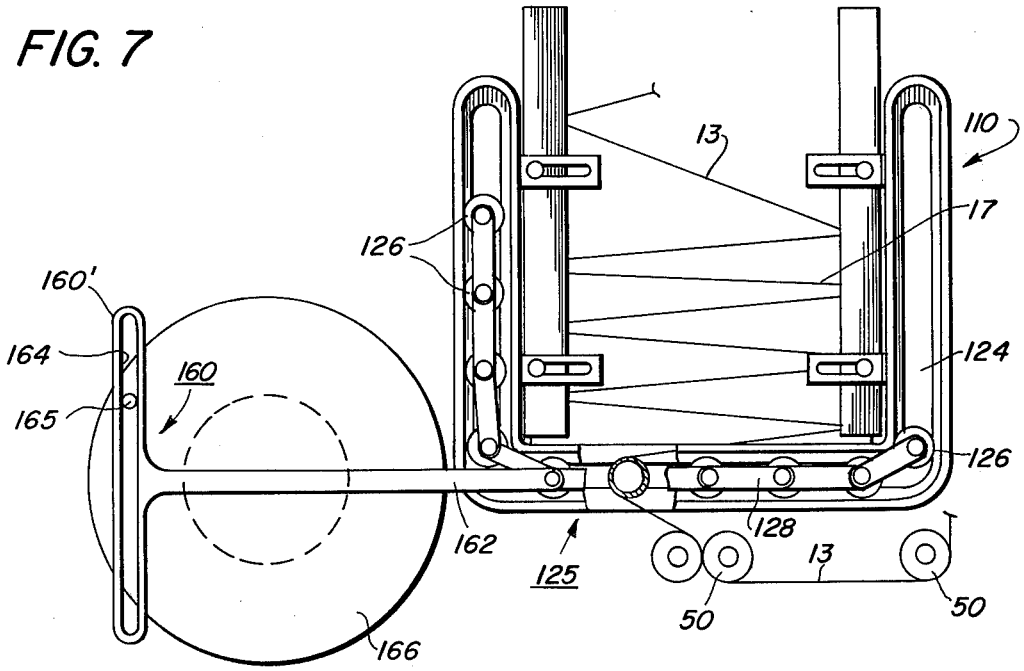
FIG. 7 is a sectional view showing an alternate construction for the tray of the present invention.

Referring to the embodiment shown in FIG. 7, wherein like, numerals designated like parts, a power source is provided to oscillate base 125 back and forth in timed relationship with unfolding of the fanfolded master 13 from pack 17. The aforesaid power source includes a slider 160 suitably supported for reciprocating movement on the copier frame. Link 162 drivingly connects slider 160 with spacer link 128. Slider 160 is generally T-shaped, the cross portion 160' thereof being slotted at 164 for receipt of drive pin 165 of driving crank 166.

To provide oscillation of base 125 in timed relationship with feed of the fanfolded web 13, crank 166 is preferably driven in harmony with sprocketed feed rolls 45. For this purpose, crank 166 is preferably driven from the same source as rolls 45, shown in exemplary fashion herein as motor 105 (see FIG. 2). Additionally, suitable means such as a geneva drive mechanism, or web buffer loop, may be provided to correlate the sinusoidal motion produced by crank 166 with the rotary motion of feed rolls 45.

Rotation of crank 166 works through the pin and slot connection 165, 164 respectively to reciprocate slider 160 and oscillate base 125 back and forth, rollers 126 thereof riding back and forth en masse within tracks 124. By timing oscillation of base 125 with feeding of web 13, base 125 serves in effect to unfold the pack 17 in unison with withdrawal of web 13 therefrom.

While the invention has been described with reference to the structure disclosed, it is not confined to the details set forth, but is intended to cover such modifications or changes as may come within the scope of the following claims.

What is claimed is:

1. A pack tray for supporting an endless web fanfolded into a pack for feeding of said web from off the bottom of said pack, the improvement comprising:

plural base members arranged in substantially parallel relationship to one another on which said pack is adapted to rest;

track means supporting the terminal ends of said base members with said base members extending therebetween for movement in a direction paralleling the direction of web unfolding, said web being disposed between an adjoining pair of said members so that on movement of said web and unfolding of said pack, said base members oscillate back and forth, and means to restrain said pack against oscillation in said tray whereby said pack remains substantially stationary during oscillation of said base members as said pack unfolds.

2. The pack tray according to claim 1, including means to maintain said base members in preset spaced relationship to one another.

3. The pack tray according to claim 1 including drive means to oscillate said members back and forth in unison with unfolding of said pack.

4. The pack tray according to claim 1 in which said base members comprise rotatable elements.

5. The pack tray according to claim 1 in which said pack restraining means comprises at least one upright side guide adjacent each end of said tray, and means supporting at least one of said side guides for movement whereby to permit the space between said side guides to be correlated with the size of the pack in said tray.

6. In a system for feeding fanfolded web material, the improvement comprising:

tray means for holding a supply of said web material pending feeding thereof, said web material being folded into a pack configuration, said tray means including a base and upstanding sides, said base and sides cooperating to form a generally U-shaped tray for receiving said pack, said sides cooperating to restrain said pack against movement along said base as said web material is fed from below said pack, said base having at least two pack supporting members for supporting said pack in said tray, said supporting members being movable back and forth along said base in a direction paralleling the direction of unfolding of said pack during feeding thereof, said web material being movable between said pack supporting members during feeding.

7. The system according to claim 6, in which said tray means includes link means to retain said pack supporting members in predetermined spaced relationship.

8. The system according to claim 6, in which said tray means base and sides comprise a track pair within which said pack supporting members ride, said track pair extending parallel to the direction of unfolding of said pack adjoining each side of said tray.

9. The system according to claim 6, including drive means to drive said pack supporting members back and forth in unison with unfolding of said pack.

10. In a system for feeding fanfolded web material, the improvement comprising:

tray means for holding a supply of said web material pending feeding thereof, said web material being folded into a pack configuration, said tray means including a base for supporting said pack and adapted to permit said web material to be fed from below said pack, said base having at least two pack supporting members movable in a direction paralleling the direction of unfolding of said pack during feeding thereof, said web material being movable between said pack supporting members during feeding, and a track pair for supporting said pack supporting members, said track pair extending parallel to the direction of unfolding of said pack adjoining each side of said tray, said track pair being U-shaped in configuration to render said tray means compact.

* * * * *